US009006622B2

(12) United States Patent
Beverly et al.

(10) Patent No.: US 9,006,622 B2
(45) Date of Patent: Apr. 14, 2015

(54) INDUCTION COOKING

(75) Inventors: David W. Beverly, Lunenburg, MA (US); Randall Mathieu, Hudson, MA (US)

(73) Assignee: Bose Corporation, Framingham, MA (US)

( * ) Notice: Subject to any disclaimer, the term of this patent is extended or adjusted under 35 U.S.C. 154(b) by 322 days.

(21) Appl. No.: 13/307,290

(22) Filed: Nov. 30, 2011

(65) Prior Publication Data

US 2012/0132647 A1 May 31, 2012

Related U.S. Application Data

(60) Provisional application No. 61/418,296, filed on Nov. 30, 2010.

(51) Int. Cl.
*H05B 6/12* (2006.01)
*H05B 6/06* (2006.01)

(52) U.S. Cl.
CPC ..... *H05B 6/062* (2013.01); *H05B 2213/07* (2013.01)

(58) Field of Classification Search
USPC ..... 219/621, 622, 623, 626, 627, 667
See application file for complete search history.

(56) References Cited

U.S. PATENT DOCUMENTS

| | | | | |
|---|---|---|---|---|
| 3,740,513 | A | | 6/1973 | Peters, Jr. et al. |
| 3,742,174 | A | | 6/1973 | Harnden, Jr. |
| 3,742,178 | A | | 6/1973 | Harnden, Jr. |
| 3,742,179 | A | | 6/1973 | Harnden, Jr. |
| 3,745,290 | A | | 7/1973 | Harnden, Jr. et al. |
| 3,777,094 | A | | 12/1973 | Peters, Jr. |
| 3,781,506 | A | | 12/1973 | Ketchum et al. |
| 3,786,220 | A | | 1/1974 | Harnden, Jr |
| 3,823,297 | A | | 7/1974 | Cunningham |
| 3,979,572 | A | | 9/1976 | Ito et al. |
| 4,381,438 | A | | 4/1983 | Goessler et al. |
| 4,490,596 | A | * | 12/1984 | Hirai et al. ..... 219/623 |
| 4,549,052 | A | * | 10/1985 | Simon ..... 219/623 |
| 4,587,406 | A | | 5/1986 | Andre |
| 4,617,441 | A | | 10/1986 | Koide |
| 4,638,135 | A | | 1/1987 | Aoki |

(Continued)

FOREIGN PATENT DOCUMENTS

| | | | |
|---|---|---|---|
| EP | 1347669 | A2 | 9/2003 |
| EP | 1732357 | A2 | 12/2006 |

(Continued)

*Primary Examiner* — Dana Ross
*Assistant Examiner* — Brandon Harvey
(74) *Attorney, Agent, or Firm* — Brian M. Dingman; Dingman, McInnes & McLane, LLP

(57) ABSTRACT

An induction cooking system with an induction heating system, a cooktop, and cool touch cookware that has a target that is heated by induction. An absolute cookware temperature is directly sensed at one or more locations of the cookware, for example at the target. A relative cookware temperature can be determined based on the value of an electrical variable of a circuit that includes the target. The cookware can include a layer of thermal insulation directly below and spaced from the target by a gap. The insulation and gap act as the major heat insulating elements to keep the outer surface of the cookware cool. This allows the induction coil to be placed just below the cooktop, without any insulation between the coil and the cooktop. The cooktop can be cooled by placing a cooling chamber just below the cooktop and drawing air through the cooling chamber. The induction coil can be located in the cooling chamber.

19 Claims, 6 Drawing Sheets

(56) References Cited

U.S. PATENT DOCUMENTS

| | | | | |
|---|---|---|---|---|
| 4,795,886 | A | 1/1989 | Carter, Jr. | |
| 5,611,227 | A | 3/1997 | Solovieff | |
| 5,893,996 | A | 4/1999 | Gross | |
| 5,951,900 | A | 9/1999 | Smrke | |
| 5,981,916 | A | 11/1999 | Griffiths et al. | |
| 6,051,821 | A | 4/2000 | Dahl et al. | |
| 6,140,617 | A | 10/2000 | Berkcan et al. | |
| 6,206,564 | B1 | 3/2001 | Adamczewski | |
| 6,232,585 | B1 | 5/2001 | Clothier et al. | |
| 6,246,033 | B1 | 6/2001 | Shah | |
| 6,274,856 | B1 | 8/2001 | Clothier et al. | |
| 6,320,169 | B1 | 11/2001 | Clothier | |
| 6,462,316 | B1 | 10/2002 | Berkcan et al. | |
| 6,630,650 | B2 | 10/2003 | Bassill et al. | |
| 6,737,617 | B1 | 5/2004 | Daum et al. | |
| 6,904,378 | B2 | 6/2005 | Schilling et al. | |
| 6,953,919 | B2 | 10/2005 | Clothier | |
| 7,005,986 | B2 | 2/2006 | Parks, III et al. | |
| 7,157,675 | B2 * | 1/2007 | Imura | 219/627 |
| 7,473,387 | B2 | 1/2009 | Temple et al. | |
| 7,557,708 | B1 | 7/2009 | Pacholok et al. | |
| 7,692,121 | B2 | 4/2010 | Pinilla et al. | |
| 2005/0006379 | A1 | 1/2005 | Sullivan | |
| 2007/0221668 | A1 | 9/2007 | Baarman et al. | |
| 2009/0065496 | A1 | 3/2009 | England et al. | |
| 2009/0065497 | A1 | 3/2009 | England et al. | |
| 2009/0065498 | A1 | 3/2009 | Beverly et al. | |
| 2009/0065499 | A1 | 3/2009 | England et al. | |
| 2009/0065500 | A1 * | 3/2009 | England et al. | 219/621 |
| 2009/0294437 | A1 | 12/2009 | Pinilla et al. | |
| 2012/0152933 | A1 | 6/2012 | Matsui et al. | |

FOREIGN PATENT DOCUMENTS

| | | | | |
|---|---|---|---|---|
| EP | 1625774 | B1 | | 9/2007 |
| EP | 1865754 | A2 | | 12/2007 |
| EP | 2094059 | A2 | | 8/2009 |
| GB | 2308947 | | | 7/1997 |
| JP | 04002084 | A | * | 1/1992 |
| JP | 6151049 | A | | 5/1994 |
| JP | 9082466 | A | | 3/1997 |
| WO | WO9941950 | | | 8/1999 |
| WO | WO2006050527 | | | 5/2006 |
| WO | WO2006126345 | A1 | | 11/2006 |
| WO | WO2007097821 | | | 8/2007 |
| WO | WO2009032979 | | | 3/2009 |
| WO | WO2009033036 | | | 3/2009 |
| WO | WO2009099445 | | | 8/2009 |
| WO | WO2010069825 | A1 | | 6/2010 |

* cited by examiner

INDUCTION COOKING

CROSS-REFERENCE TO RELATED APPLICATION

This application claims priority of Provisional Application Ser. No. 61/418,296, filed on Nov. 30, 2010, the disclosure of which is incorporated herein by reference.

FIELD

This disclosure relates to induction cooking systems.

BACKGROUND

In induction cooking, an alternating current in an induction coil produces a time-varying magnetic field that induces current flow in a conductive (typically ferromagnetic) target that is a part of the cookware. The induced current flow causes the target to heat. The heat is transferred to the cooking surface for heating or cooking food or other items located on the cooking surface of the cookware.

SUMMARY

An induction cooking system may benefit from measuring the cooking temperature of cookware used in the system. For example, a system which monitors the cooking temperature of its cookware can control the delivery of energy to the cookware to improve cooking performance or to ensure the cookware stays within a safe (or desired) temperature operating range. Temperature sensors can fail or become unreliable for periods of time, and, as such, it can be beneficial to have a system with redundant temperature sensing capability. An absolute cookware temperature can be sensed directly with a contact or non-contact temperature sensor. The temperature sensor can be embedded in the cookware. A relative cookware temperature can be sensed by detecting changes in one or more parameters of an electrical circuit that includes a heated element of the cookware. Once the relative temperature is calibrated to the absolute temperature, the relative temperature becomes a reliable indicator of absolute temperature. This accomplishes redundant temperature sensing capability using only one physical temperature sensor.

Further, an induction cooking system that exclusively uses cool-touch cookware can be designed such that thermal barriers are positioned above the cooktop, thus permitting relatively delicate electronic components (such as an induction coil or microprocessor controllers) to be positioned very near (or even within) the cooktop surface and without any (or little) additional thermal protection. The cookware includes a target that is heated by electrical currents induced in the target by the electromagnetic field produced by an induction coil. The thermal barrier can include a layer of thermal insulation in the cookware, spaced from and directly below the target. The thermal barrier can also include the gap between the target and the insulation.

Cooling of the cooktop can be accomplished with a cooling chamber such as a plenum that is separate from the induction coil power electronics. The cooling chamber is immediately below the cooktop such that the lower cooktop surface forms the upper boundary of the cooling chamber. A cooling system such as a ventilation system moves cooling fluid, typically ambient air, through the cooling chamber. The cooling fluid helps to maintain the cooktop at a lower temperature than the outside of the cookware, which assists with transfer heat out of the cookware and keeps the cookware cool to the touch.

In general, one aspect of the disclosure features an induction cooking system that has an induction coil and an induction coil drive system that provides ac power to the induction coil. An absolute cookware temperature is directly sensed at one or more locations of the cookware. A distributed relative temperature of the cookware is indirectly sensed. The sensed absolute and relative temperatures can be compared, to accomplish an absolute temperature sensor that is responsive to a distributed temperature of the cookware.

The cookware temperature may be directly sensed using one or more temperature sensors that are physically coupled to the cookware. The cookware may comprise a target that is heated by induction, and a temperature sensor may be physically coupled to the target. The relative temperature of the cookware may be indirectly sensed using a first coil that is spaced from the cookware; the first coil may be located within or under the cooktop. The indirect cookware temperature sensing may be accomplished by measuring the value of an electrical variable of the circuit that comprises the first coil. The first coil may be but need not be the induction coil.

The relative temperature sensing aspect can be calibrated by correlating the sensed electrical variable with the directly sensed absolute cookware temperature. Calibration may be accomplished at least in part when the cookware is at a generally isothermal condition, which can be identified by determining an inflection point in the value of the sensed electrical variable and determining simultaneous relatively constant directly sensed temperature.

Various additional implementations may include one or more of the following features. The directly and indirectly sensed temperatures and a comparison of the two can be used to indicate an induction cooking system failure; this may be accomplished by determining whether the directly and indirectly sensed temperatures are within a safe temperature range, determining whether the directly and indirectly sensed temperatures are similar, determining whether the directly and indirectly sensed temperatures are changing in a similar manner, determining whether the absolute cookware temperature has recently been directly sensed, and determining whether calibration settings for the distributed relative temperature are within a predetermined operational range.

In general, another aspect of the disclosure features an induction cooking appliance that has a module comprising power electronics, one or more electrical coils operatively connected to the power electronics, a cooktop having an upper surface and a lower surface, and a cooling chamber, separate from the power electronics module. The lower surface of the cooktop forms a boundary of the cooling chamber. There is also a cooling system that flows cooling fluid through the cooling chamber. The cooling chamber may comprise a plenum coupled to the lower surface of the cooktop.

Various implementations may include one or more of the following features. The cooling system may include one or more fans that draw air into the cooling chamber. The cooktop may be generally planar, relatively thin, and have an edge along its perimeter; the cooling chamber may have air inlet openings in or proximate the edge. The cooktop perimeter may be generally rectangular and have four edges, and the air inlet openings may be in or proximate all four edges. The cooktop may be supported by a base that has a top front edge, and the cooktop may have a lip portion that extends past the top front edge of the base such that the lip portion projects forward of the top of the base; the air inlet openings may be in this lip portion.

The electrical coils may be located in the cooling chamber. The cooling chamber may have a lower boundary. The lower surface of the cooktop may form the upper boundary of the cooling chamber. The electrical coils may be spaced from both the lower boundary and the upper boundary of the cooling chamber. The electrical coils are typically spaced from one another and the cooling chamber may further comprise baffles in spaces between the coils, the baffles extending essentially from the lower boundary of the cooling chamber to the lower surface of the cooktop. The cooling chamber may have unoccupied air gaps between the tops of each of the coils and the adjacent lower surface of the cooktop. The power electronics module may be located below the cooling chamber.

The induction cooking appliance may further comprise custom cookware configured to be placed on the cooktop above an electrical coil, and a temperature sensing system that senses a temperature of the custom cookware. The temperature sensing system may comprise a temperature sensor that senses a temperature of the target. The temperature of the cooktop underneath the portion of the outer wall of the cookware that is on the cooktop is preferably less than the temperature of the portion of the outer wall of the cookware that is on the cooktop.

In general, in another aspect the disclosure features an induction cooking system with an induction cooking appliance and custom cookware. The induction cooking appliance includes a cooktop having an upper and lower surface, power electronics located below the lower surface of the cooktop, and an electrical coil positioned below the lower surface of the cooktop. The electrical coil is operatively connected to the power electronics and configured to produce an electromagnetic field when the coil is energized by the power electronics. The custom cookware is configured to be placed on the cooktop above the electrical coil, and includes an inner wall comprising a target formed of an electrically conductive material and an outer wall formed at least partially of a first layer of thermal insulation material, wherein the first layer of thermal insulation material is spaced from the target such that there is a gap between the thermal insulation and the target.

Various implementations may include one or more of the following features. The cookware may further include a seal between the inner and outer walls, and a space between the inner and outer walls. The target layer may be in the space, physically coupled to the inner wall and spaced from the outer wall. There may be a temperature sensor operatively coupled to the target, and a transmitter operatively coupled to the temperature sensor. The pressure in the space between the walls of the cookware may be less than 14.7 pounds per square inch. The space may include a gas that is less heat conductive than air. The thermal resistance of the space between the inner and outer walls and the first layer of thermal insulation material in combination may be at least 10 degrees C per watt. The electrical coil may be positioned immediately below and spaced from the lower surface of the cooktop.

The induction cooking system may also include a controller operatively coupled to the transmitter. There may also be one or more cooktop cooling fans. The controller may control the cooling fans based at least in part on the temperature of the target. The controller may be arranged to determine whether the seal has failed by determining one or more of whether a structure that is in contact with the outer wall of the cookware has exceeded a predetermined temperature, whether a temperature in the space between the inner and outer walls has exceeded a predetermined temperature, whether a pressure in the space between the inner and outer walls is outside of a predetermined pressure range, whether a pressure in the space between the inner and outer walls is not changing in a predetermined manner as the cookware temperature changes, and whether one or more physical portions of the cookware that are in or exposed to the space between the inner and outer walls have been displaced.

The temperature sensor may be a direct contact temperature sensor physically coupled to the target, or may be a non-contact sensor. The cookware may include a power coil tuned to couple to an electromagnetic field produced by the electrical coil to generate electrical power sufficient to operate the transmitter. The transmitter may comprise an RF enabled microprocessor. The cookware outer wall may be made at least in part of electrically non-conductive material, and the transmitter may be spaced from the first layer of thermal insulation material. The transmitter may comprise a second temperature sensor.

DETAILED DESCRIPTION

An induction cooking system may benefit from measuring the cooking temperature of cookware used in the system. For example, a system which monitors the cooking temperature of its cookware can control the delivery of energy to the cookware to improve cooking performance or to ensure the cookware stays within a safe (or desired) temperature operating range. Temperature sensors can fail or become unreliable for periods of time, and, as such, it can be beneficial to have a system with redundant temperature sensing capability.

Further, an induction cooking system that exclusively uses cool-touch cookware can be designed such that thermal barriers are positioned above the cooktop, thus permitting relatively delicate electrical and electronic components (such as an induction coil or microprocessor controllers) to be positioned very near (or even within) the cooktop surface and without any (or little) additional thermal protection.

Cooling of the cooktop can be accomplished with a cooling chamber such as a plenum that is separate from the induction coil power electronics. The cooling chamber can be immediately below the cooktop such that the lower surface of the cooktop forms the upper boundary of the cooling chamber. A cooling system such as a ventilation system can move cooling fluid, typically ambient air, through the cooling chamber. The cooling fluid acts to maintain the cooktop at a lower temperature than the outside of the cookware, which helps to transfer heat out of the cookware and keep the cookware cool to the touch.

Figure 1:
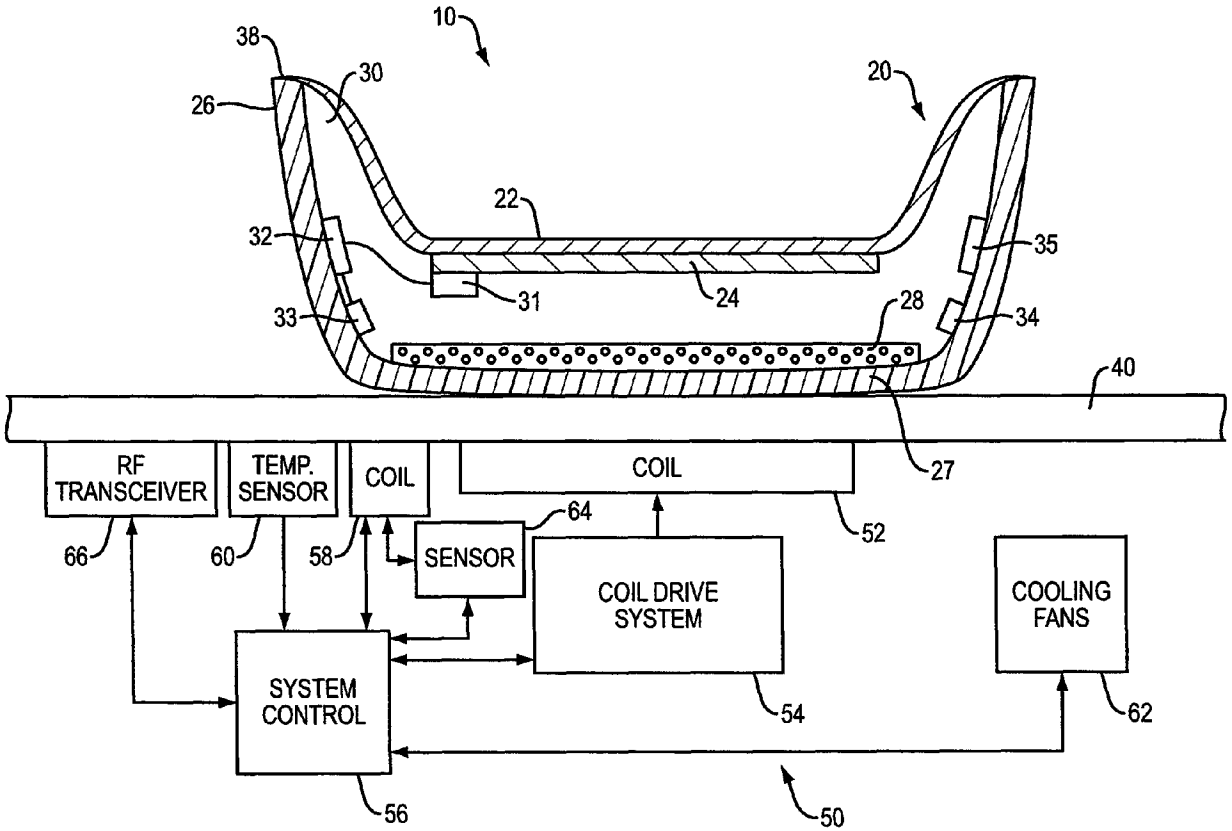
FIG. 1 is a highly schematic, partially cross-sectional view of an induction cooking system.

For example, as shown in FIG. 1, induction cooking system 10 includes a piece of cool-touch cookware 20 located on cooktop 40. Beneath cooktop 40 is an induction heating system 50. In operation, the induction heating system 50 produces a time-varying electromagnetic field that induces eddy currents in a target 24 in the cookware. The eddy currents rapidly heat the target, which in turn heats an inner wall 22 of the cookware where food or liquid is placed. As will be described further below, the system 10 includes redundant temperature sensing capability by including both a direct temperature sensor and an indirect temperature sensor.

Cool-touch cookware 20 comprises inner wall 22 that heats food or liquid (not shown) placed within the cavity formed by wall 22. Cookware 20 also includes outer wall 26 that is preferably made fully or partially from a material that is not heated by the time-varying electromagnetic field produced by the induction coil 52. By having an outer wall that is transparent to the electromagnetic field, little power is dissipated in the outer wall due to the field such that there is little direct heating of the outer wall by the field. This helps to keep the outer surface of the outer wall relatively cool during use. Outer wall 26 can be made from a plastic material such as bulk molding compound, melamine or liquid crystal polymer. Inner wall 22 and outer wall 26 are preferably spaced from one another to define space 30 between them. Inner wall 22 and outer wall 26 are sealed to each other along the perimeter 38 of the cookware 20 and a space 30 is formed between the inner and outer walls. The space 30 is used to house other elements of the cooking system 10 and can also help thermally isolate the outer wall from the target and the inner wall.

Target 24 is made from an electrically conductive material and preferably a ferromagnetic material such as 400 series stainless steel, iron or the like. Target 24 is the primary material that is inductively heated via the electromagnetic field generated by inductive coil 52. Preferably, target 24 is directly coupled to inner wall 22 to provide effective heat transfer from target 24 into wall 22.

A layer of thermal insulation material 28 is located within space 30 and positioned beneath target 24. Insulation material 28 helps to inhibit radiant and convective heat transfer from target 24 to outer wall 26. Insulation material 28 may be located only on the bottom portion 27 of outer wall 26 as shown in the drawing or may extend partially or fully up along the inside of the upper portion of wall 26. Insulation material 28 is preferably spaced from target 24; alternatively it may fill some or essentially all of cavity 30. Insulation material 28 is preferably formed of materials that are not substantially affected by the electromagnetic field produced by the induction coil. For example, the insulation material may be a layer of aerogel that is bounded on both faces by a thin reflective film such as a metalized plastic film. The metalized layer may have breaks formed in the conductive surface to minimize generation of eddy currents. The thickness of the metalized layer may be made significantly smaller than the skin depth of the eddy currents in the metallization material. In some embodiments, the insulation may be a thermally insulating mat material. In some embodiments, the insulation material is spaced away from the inner wall so that a small gap is formed between the inner wall structure and the bottom surface of the insulation material. The insulation material is effective at inhibiting heat transfer between target 24 and the portion of outer wall 26 that is covered by insulation 28. Heat transfer can be further inhibited by other constructional aspects such as creating a vacuum within space 30 or filling space 30 with a material that is a poor heat conductor, such as a gas such as argon gas. Further examples and description of cool-touch cookware are disclosed in commonly-assigned U.S. patent application Ser. No. 12/205,447, filed on Sep. 5, 2008, the disclosure of which is incorporated herein by reference.

Induction heating system 50 comprises induction coil 52 located just underneath or potentially embedded within cooktop 40. Cooktop 40 is preferably made from a ceramic glass material. However, in a system that exclusively uses cool touch cookware (like cookware 20), many other materials may be used for cooktop 40, including materials that have relatively poor heat resistance (compared to ceramic glass). For example, materials such as solid surface countertop materials, wood, tile, laminate countertop materials, vinyl, glass other than ceramic glass, or plastic, may be used for the cooktop.

Coil drive 54 provides alternating current to induction coil 52 under control of controller 56. Controller 56 is preferably a microprocessor that executes software or firmware to control operation of the induction coil 52 and other aspects of heating system 50. Controller 56 can use temperature data about the cookware in its control. The use of a controller to control operation of a coil drive for an induction coil in an induction cooking system is further disclosed and described in commonly-assigned U.S. patent application Ser. No. 12/335,787, filed on Dec. 16, 2008 (published as publication 2010/0147832 A1), the disclosure of which is incorporated herein by reference.

System 10 may use redundant temperature sensing. Specifically, system 10 may use both direct and indirect temperature sensing. A direct temperature sensor 31 is coupled to the target 24 and is located within the space 30 between the inner and outer walls of the cookware 20. In this example, the direct temperature sensor 31 directly contacts the target 24 and thus provides a direct temperature reading of the target. However, non-contact direct temperature sensors can also be used, such as optically-based sensors. Direct temperature sensor 30 may be any known contact or non-contact temperature sensor such as a thermocouple, thermistor, infrared sensor, etc. Additionally, while the example in FIG. 1 shows only one direct temperature sensor coupled to the target, other implementations may use multiple direct temperatures sensors. Also, other implementations may use direct temperature sensors coupled to the inner wall in lieu of or in addition to a direct temperature sensor coupled to the target.

In the example depicted in FIG. 1, temperature sensor 31 is coupled to target 24 either by direct contact, or indirectly via a temperature conductive substance such as heat conductive epoxy. Temperature sensor 31 determines an absolute temperature of the cookware, i.e., the temperature of target 24 at the contact location of temperature sensor 31. A non-contact sensor such as an optical sensor could be located spaced from target 24 and/or inner wall 22, for example in space 30 or in or on the inside of outer wall 26.

Cookware 20 further includes wireless transmission device 32 that is operatively connected to the direct temperature sensor 31 to receive its sensed temperature data. The wireless transmitting device 32 transmits the sensed temperature to the induction heating system 50 where it is used as an input to the controller. In one non-limiting implementation, wireless transmission device 32 may be a radio-frequency (RF) enabled microcontroller that communicates via RF with RF transceiver 66. An RF enabled microcontroller can also communicate cookware identification information, which allows cookware temperature calibration data to be associated with the particular cookware. The cookware information can be located in memory associated with the induction cooking system, or memory embedded in the cookware itself. As one example, if calibration data for a particular piece of cookware is held in memory of the induction cooking appliance as opposed to the cookware, and cookware identification information is transmitted from the cookware once it is placed over a coil and the cooking system is turned on so as to operate the coil, the cookware temperature calibration developed specifically for the subject piece of cookware will remain associated with the piece of cookware regardless of which cooktop induction coil it is used with.

Power can be provided to wireless transmission device 32 using pick-up coil 33 that is operatively connected to wireless transmitter 32. Pick-up coil 33 is inductively coupled to the induction heating system 50 to provide power to the wireless transmitter 32 during operation. When such an energy pick-up coil 33 is used, it may be physically located closer to induction coil 52 than shown in the drawing, for example, embedded within or just below or on top of the lower portion 27 of cookware outer wall 26. Closer physical proximity generally accomplishes better electromagnetic coupling, which improves efficiency of the power transfer from the induction coil to the energy pickup coil.

In addition to direct temperature sensor 31 that senses one or more specific locations within the cookware 20, system 10 includes an indirect temperature sensor that indirectly senses a distributed relative temperature of the cookware. In the example shown in FIG. 1, indirect temperature sensing is accomplished by using a secondary coil 58 located under or within cooktop 40 and spaced from the cookware 20 during use. Secondary coil 58 is part of a resistor-inductor-capacitor (RLC) circuit that also includes the target 24. As the temperature of target 24 changes, its resistance and permeability changes, which causes a change in the RLC circuit. When this RLC circuit is excited with a known time-varying signal such as a sine wave or a square wave, changes in electrical parameters of the circuit are correlated with temperature changes in the target 24, which modulates the excitation signal. The modulations can be detected and thus provide a way of indirectly sensing the distributed temperature of cookware 20. This indirect temperature sensing is useful for inductive cookware with a cool outer surface such as cookware 20, or other inductive cookware with a hot outer surface. The indirectly sensed temperature is correlated with the average temperature of the target. The detected temperature data is sensitive to the relative change in temperature of the target. A calibration step is required in order to relate the sensed data accurately to the absolute temperature of the target.

In the example shown in FIG. 1, a separate voltage or current sensor 64 is used to sense voltage across the coil (in the case of a voltage sensor) or current in the coil (in the case of a current sensor). When a known time-varying signal is applied to the coil 58, the coil electrically couples to the target and, as the target changes in temperature, the voltage (and current) in the coil 58 likewise changes. The voltage or current changes can be correlated to temperature changes in the target by controller 56. It should be noted that while FIG. 1 shows a secondary coil 58, other implementations may use the primary coil 52 to indirectly detect changes in the temperature of the target.

In addition, other electrical parameters such as the voltage and/or current of the power provided by coil drive system 54 to primary coil 52 or secondary coil 58 also are inherently known as part of drive system 54. This information can be provided to controller 56 directly from coil drive system 54 rather than the information being detected by a separate sensor 64. Changes in directly provided coil drive current or voltage can be correlated to target temperature changes in the same manner as described above. This obviates the need for a separate sensor 64. Still other measured RLC circuit values can be used as the basis for independent temperature sensing, including its resonant frequency, resonant damping, peak to peak current excitation when excited with a square wave, and various other methods of target resistance measurement that would be apparent to one skilled in the art.

Induction heating system 50 can be used to determine the capacitance of the RLC circuit used for the indirect temperature measurement. This can be done without cookware present, so that the cookware target does not form part of an inductive tank and thus contribute to the capacitance determination. Because wire production and coil winding are typically tightly controlled in the coil manufacturing process, the resistance and inductance of the RLC circuit that includes the coil can be predetermined, and can be assumed to be essentially constant from coil to coil. However, the capacitance of the RLC circuit can vary over a wide range from hob to hob. The capacitance of the coil (e.g., either main coil 52 or secondary coil 58, FIG. 1, can be determined by electrically driving the coil using coil drive system 54 under control of system controller 56. While the coil is being driven, the value of one or more electrical parameters of the RLC circuit is determined. For example, knowing L and R, the resonant frequency of the RLC circuit can be measured and then used to determine the capacitance of the circuit. Alternatively, the value of an electrical parameter that varies with capacitance of the RLC circuit can be determined a priori and stored in memory. The measured value of this parameter can then be used to determine capacitance. Since the capacitance has a large effect on the resonance of the tank, knowledge of the capacitance helps to provide more accurate results in the indirect temperature determination when a particular target (thus a particular piece of cookware) is present that has not been previously calibrated to the particular induction heating system 50. The capacitance measurement thus provides greater temperature measurement accuracy without the need to calibrate each piece of cookware to each hob.

The indirectly sensed temperature is preferably calibrated to an absolute cookware temperature to improve accuracy of the indirectly sensed temperature. Calibration can be done before the system is used to cook food and/or during one or more cooking operations. Because calibration improves the accuracy of indirect temperature sensing, it can allow the indirect sensing to be used as an effective absolute temperature sensor. Thus, the indirect temperature sensing can be used as a back-up in case the direct temperature sensor fails.

Calibration can be accomplished by setting the cookware to a known temperature and then measuring the value of an electrical variable of the RLC circuit and equating the known temperature with the variable value, and saving the data in a look-up table or other memory. The correlation between the indirect sensing and the absolute cookware temperature should be accomplished while the cookware is at one or more known temperatures. A known temperature can be provided by including absolute temperature sensor 31. Thus, calibration of the cookware can be accomplished while the cookware is being used to cook food, without the use of any special equipment or procedures. If the temperature calibration data and the cookware identification data are stored in a memory associated with system control 56, whenever the cookware is placed on the cooktop over coil 52 the temperature calibration data can be retrieved and used. Temperature calibration data can also be updated as the cookware is used over time.

Additionally or alternatively, the absolute temperature can be derived from the operation of system 10 itself, without the use of an absolute temperature sensor. For example, one or more sensed RLC circuit electrical parameters can be an indication of an isothermal condition of the cookware. As one non-limiting example, if water is placed in the cookware and allowed to boil, the water temperature will remain at the boiling point. When the cookware is in a relatively isothermal condition after equilibrating at the boiling point, the resistance and permeability of the target will remain relatively constant. Accordingly, determining an inflection point in the sensed electrical parameter of the RLC circuit can be an indication of an isothermal condition, such as steadily boiling water. The controller can calibrate the indirect temperature sensor by correlating the inflection point in the sensed electrical parameter of the RLC circuit with the boiling temperature of water.

An isothermal cookware condition can also be detected based on the simultaneous detection of a relatively constant directly-sensed temperature and a relatively constant alternating signal supplied to the induction coil. This condition is indicative of a constant power being used to heat the cookware contents and a constant temperature of the cookware contents, and so implies that the cookware contents are at or close to the cookware temperature; in other words the cookware is at an isothermal state. The controller can calibrate the indirect temperature to the directly sensed temperature at an isothermal condition of the cookware determined by any of the above methodologies, or in other manners as could be determined by one of ordinary skill in the art.

Calibration of indirect temperature sensing to direct temperature sensing across the normal operating range of the cookware can be accomplished by heating the cookware to at least the highest expected operating temperature of the cookware, shutting off the power to induction coil 52 to stop the heating, and then taking measurements of and equating the absolute and indirect temperature as the cookware cools.

System 10 can also be enabled to perform calibration of the indirectly-sensed temperature when commanded to do so by the user via the user interface. Calibration at nominally 100° C. can be enabled when the cookware contains boiling water. Higher temperature calibration can be enabled when a liquid such as cooking oil that will not boil at normal cooking temperatures is heated above 100° C.

The system 10 thus directly senses the absolute cookware temperature at one or more locations of the cookware. System 10 can also indirectly sense a distributed relative temperature of the cookware. Both sets of data coming from the same cookware accomplishes redundancy that allows for cross checks that may improve the reliability of temperature measurement. The access to both measurements and the ability to rely on either one or both of them provides several functional capabilities. Also, comparisons of the directly and indirectly sensed cookware temperatures can provide an indication as to whether a failure has occurred in the system 10. For example, a failure can be indicated if either (or both) of the directly or indirectly sensed temperatures fall outside of a safe temperature range. This can be useful to help prevent damage or injury due to overheating.

Comparisons between the direct and indirect temperature measurements can detect failure of one of the temperature sensors since both temperature measurements should change in a similar manner. One temperature measurement showing an increasing temperature while the other shows decreasing temperature, or one temperature measurement showing increasing temperature at a fast rate while the other stays nearly constant or increases at a slow rate, are examples of conditions that can be an indication of a failure of one or both temperature sensors. Thus, if the directly and indirectly sensed temperatures are not changing in a similar manner, the direct or indirect (or both) temperature sensor may have failed.

The direct temperature sensing function can also be determined to be problematic if a wireless transmission of temperature data from the cookware is not received within an expected time frame, or if the wireless data received indicates a potential problem with the temperature sensor itself. For example, a dramatic temperature change in a short period of time can indicate that the direct temperature sensor or the wireless transmitter has failed. In the case where the indirect sensing has been calibrated to the direct sensing, the calibration settings themselves should stay within a predetermined operational range or else there can be an indication of a failure. Appropriate action (such as issuing a warning to the user and/or disabling the induction coil power source) can be taken upon indication of a failure.

The directly sensed absolute temperature and the indirectly sensed distributed relative temperature of the cookware also can be compared in a desired manner in system controller 56 to accomplish an absolute temperature sensor that is responsive to a distributed temperature of the cookware. Such comparison can be, for example, the average of the two or some other weighted combination of the two, the absolute difference, the difference in the rate of change, or other manners of comparison including but not limited to those described herein. An average or other combination could be more accurate for a whole cookware temperature measurement than either of the two alone, so could be useful in a feedback temperature control system.

System controller 56 can also determine the rate of change of the cookware temperature (based on either one of the directly and indirectly sensed temperatures, the two together and/or a separate comparison of the two) as a function of applied power. If there is no food or other substance in the cookware, the measured temperature will likely increase more quickly as a function of applied power than when there is food or liquid in the cookware. The rate of change of temperature as a function of applied power can thus be used as an indication of an empty or almost empty pan or other piece of cookware being located on the hob with the induction heater turned on. The controller 56 can take appropriate action when an "empty pot" condition is detected. For example, the user could be notified with a visual or auditory alert after some amount of predetermined time (e.g., to account for the cookware being pre-heated). Alternatively or in addition the system could automatically reduce the power to the coil to a lower level or shut it off completely as both a safety measure and a means of saving energy.

Figure 2:
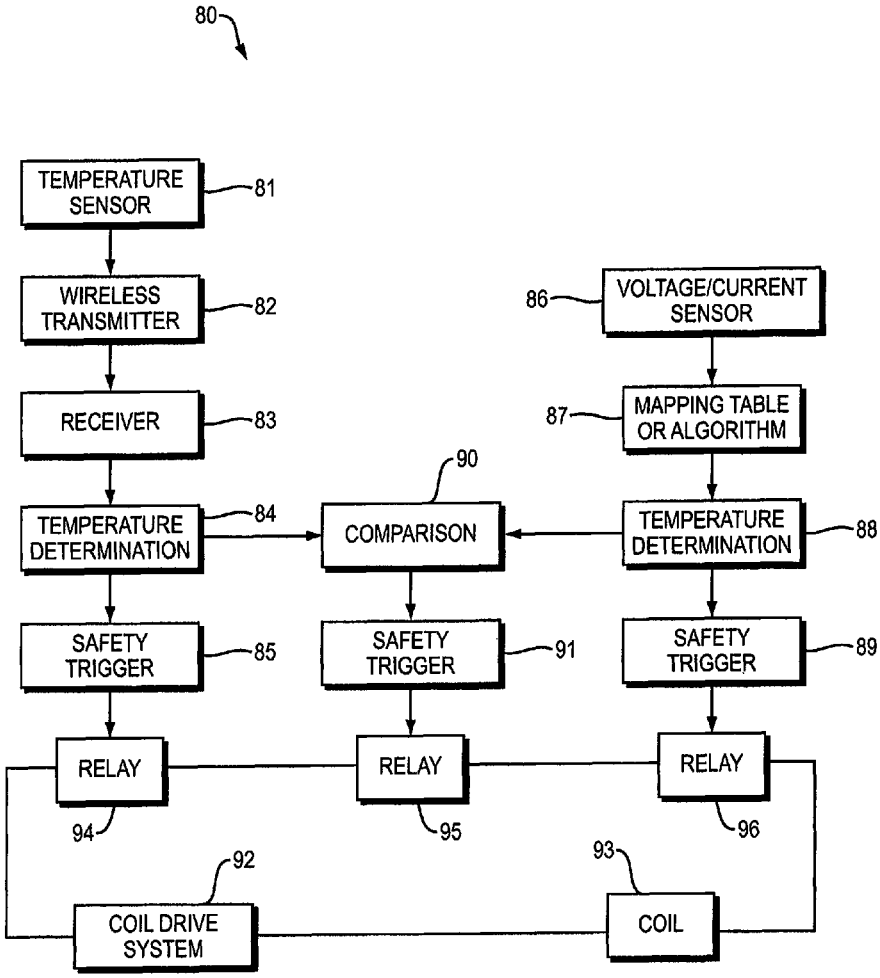
FIG. 2 is a schematic diagram of a system that uses directly and indirectly sensed temperatures to accomplish more reliable and safer operation of an induction cooking system.

Block diagram 80, FIG. 2, illustrates one non-limiting embodiment of a system in which an absolute temperature is sensed directly from the cookware, a relative temperature is sensed remotely, the two sensed temperatures are compared to form a value that relates in some manner to one or both of the sensed temperatures, and each of the three temperature determinations are used to accomplish a triple-redundant overheating detection system. Direct temperature sensor 81 (located in or on the cookware) is operatively connected to wireless transmitter 82 (also located in or on the cookware) that transmits data to receiver 83 (located underneath the cooktop). Temperature determination 84 that is based on the received data, and safety trigger 85, may both be accomplished with a single microprocessor.

Indirect distributed cookware temperature measurement is accomplished in this embodiment by sensing a parameter of the RLC circuit, in this case the voltage across the induction coil or the current in the coil, using sensor 86. Prior correlation of the value of the sensed parameter to the actual cookware temperature is used to create a table or algorithm 87 that is then used to convert the value from sensor 86 to a distributed cookware temperature determination 88. The temperature data is used by safety trigger 89. Blocks 87, 88 and 89 can be accomplished with a single microprocessor.

Temperature determinations 84 and 88 are compared 90 and this comparison is used in a third safety trigger 91. Blocks 90 and 91 can be accomplished with a single microprocessor. Comparison 90 can rely on and compare temperatures 84 and 88 in a desired manner, as described above.

Redundancy in cookware temperature measurement and comparison of sensed temperatures provides additional data that can increase the confidence that the measured values are correct. Thus, if a temperature sensor, either of the ends of a wireless link or any of the microprocessors fails, for example, the cookware temperature can still be determined. Redundancy and comparison also increases the system safety. For example, the induction cooking system can be designed to shut down induction coil 93 if any of the temperatures are out of range, and/or in other failure circumstances as described above. Shutoff can be accomplished by including relays 94, 95 and 96 in series with power supply 92 to coil 93, each operated by the output of one of the safety triggers. Multiple relays create additional redundancies that increase the reliability of the emergency shutoff system. Another manner of disabling the induction coil would be to turn off the gate drive in coil drive system 54, FIG. 1.

In existing induction cooktops the outside of the cookware is hot. The cooktop close to the cookware is also hot. Overheat safety systems thus use a temperature sensor in the cooktop as the input to the overheat safety system. In the present system the outside of the cookware may be cool, which keeps the cooktop relatively cool. The cooktop temperature may thus not be a reliable indicator of cookware temperature. The redundant cookware temperature determination described herein can be used both for cooking purposes and safety purposes in a system in which the outer surface of the cookware is cool. The system and method are also useful with traditional induction cookware in which the outer surface is hot.

System 10, FIG. 1, may include additional functional features that contribute to the operation and safe use of system 10, cookware 20 and system 50. For example, system 10 may be enabled to determine when seal 38 has failed and allowed moisture to infiltrate sealed space 30. One reason this information would be useful to know is that such moisture could by heated by target 24 and thus heat cookware outer wall 26, which could lead to a dangerous or damaging condition. Also, moisture could affect the operation of devices located in or exposed to space 30, such as temperature sensor 31 and wireless transmitting device 32. Moisture detection could be accomplished directly with a moisture or humidity sensor, not shown in the drawing. Moisture could be determined indirectly in a desired fashion. One example would be determining whether a structure that is in contact with the outside of the cookware, or perhaps the outside of the cookware itself, has exceeded a predetermined temperature. This could be accomplished with a temperature sensor located on the inside of, embedded within, or on the outside of outer wall 26. One example could be that the RF enabled processor 32 used for wireless transmission could be enabled to have a thermocouple junction or other functionality that sensed the temperature at its location within or adjacent to space 30. This information could be among the information transmitted by wireless device 32 to RF transceiver 66 for provision to system control 56. This third manner of cookware temperature sensing can add a triple redundancy to system 10. Further, if this third temperature measurement is calibrated (e.g., as described above regarding the indirectly-sensed temperature), it could potentially be used to estimate the actual cookware temperature. Another way to sense heating of outer wall 26 is to sense heat flow into or through cooktop 40. This could be accomplished with temperature sensor 60 located just below or embedded within or even on the top surface of cooktop 40 underneath the location at which cookware 20 will be located during use of the induction coil. The output of temperature sensor 60 would be provided to system control 56.

Two other manners by which moisture infiltration into sealed space 30 can be detected include detecting whether a pressure in the sealed space has changed unexpectedly, and determining whether one or more physical portions of the cookware that are in or exposed to the sealed space have been displaced via thermal expansion caused by unexpected heating of the moisture in space 30. Pressure sensor 34 that senses the pressure in sealed space 30 may be included. If moisture infiltrates space 30 and is heated, the pressure in sealed space 30 may increase more than would be the case due to normal heating of space 30 during normal cookware operation. Also, if the seal remains open after failure, the pressure in space 30 may not rise to the extent that would be expected due to normal heating of space 30 during normal cookware operation with an intact seal. Pressure sensor 34 can sense the pressure and provide pressure data to system control 56. Data transmission could be accomplished via wireless transmitter 32, in which case pressure sensor 34 would be operatively connected to device 32. Alternatively or additionally, displacement sensor 35 may be located in space 30 or located against a structure that is within or exposed to space 30. Sensor 35 could sense small movements caused by overheating of such structure due to heating of moisture in space 30. As with the pressure sensor, the data from sensor 35 would be provided to system control 56.

The induction cooking system shown in FIG. 1 places much of the thermal insulation material within the cookware 20 in order to realize a "cool touch" cookware. Because the outer surface of the cool cookware is relatively cool, the upper surface of cooktop 40 also remains relatively cool. By ensuring a relatively cool cooktop, delicate electronics under the cooktop do not need much (if any) thermal protection. Additionally, because the outer surface of the cookware is maintained at a temperature well below that of the target, the cooktop surface is not hot as it is with traditional induction cooking systems. Accordingly the main coil 52 (and any secondary coils) can be moved close to the top surface of cooktop 40, for example embedded within the cooktop 40 or placed directly against (or near) the bottom surface of cooktop 40 without danger of the coils overheating due to heat transfer through the cooktop into the coils. This allows coil 52 to more directly couple to target 24, thus increasing the efficiency of power transfer in the system 10. Moreover, if the coil is touching the cooktop, the cooktop itself can act as a heat sink for the coil. (The coil will also function as a heat sink for the cooktop, depending on the power levels and thus the resistive heating of the coil.)

In system 10, the high thermal resistance elements (the gap below the target and the insulation) are located within the cookware as opposed to being located below the cooktop. By placing the high thermal resistance elements in the cool-touch cookware, the system reduces the temperature of the elements located on the opposite side of the high thermal resistance element from the main heat source (the induction target within the cookware). In this case, the elements that see reduced temperature are thus the outer surface of the cookware, the cooktop surface, the induction coil, and the power electronics (which includes the coil drive system). In this system, substantially less heat is transferred from the cookware into the induction cooking hardware (the cooktop encasing the coil and electronics) than in the traditional system. Thus, little or no insulating material is needed below the cooktop, and, as mentioned above, the induction coils and if desirable the electronics can be moved closer to the cooktop surface.

Furthermore, the design criteria for the thermal resistance elements is different in a cool-touch cookware system than in a non-cool touch cookware system. In a non-cool touch cookware system, the ambient temperature of the operating environment of the power electronics and coil is kept to a range that does not exceed the thermal operating limits of the hardware. In a cool touch cookware system, the thermal resistance elements are selected to avoid having surfaces accessible to a user that could burn or injure. These operating criteria are different and result in different requirements for the thermal resistances of the different elements. For example, the thermal resistance of the high thermal resistance element in the cool-touch cookware system (which may be, for example, an air gap, a piece of insulation, a vacuum, a vacuum insulation panel, or any combination thereof) should be at least 3 degrees C. per watt, preferably at least 4.4 degrees C. per watt, and more preferably at least 10 deg C. per watt, in order to keep temperatures of the exterior of the pan below approximately 70 deg C. under the majority of operating conditions. Because the ambient environment of power electronics may tolerate higher temperatures, and because less heat is conducted into the power electronics compartment than is present at the surface of the induction target, a lower thermal resistance for the high thermal resistance element in a non-cool touch cookware system can be used.

As mentioned above, a further benefit of moving the high thermal resistance element into the cookware is that it allows the coil to be optimally located based on other considerations such as efficiency of the coupling between the induction coil and the target, and optimal routing of air within the electronics compartment to dissipate heat radiated into the space by the power electronics and the coil, without having to insulate for heat soak back into the cooktop from the cookware.

The lower temperature at the upper surface of cooktop 40 also allows a reduction in the use of cooling fan(s) 62 for cooling of cooktop 40: potentially fewer fans operating at reduced power. The reduction in the cooktop temperature can also support changing air management around cooktop 40 and system 50. For example, the power electronics will be hotter than the cooktop. Thus, air from cooling fans 62 can be directed over the lower cooktop surface before being directed to the power electronics, which helps to keep the cooktop cool. Knowledge of cookware temperature can also allow better management of cooling fans used to cool the cookware. For example, when the cookware is hotter the fan speed can be increased via controller 56 to help cool the cooktop and thus draw more heat from the cookware so as to maintain the outer surface of the cookware at a low temperature.

Figure 3:
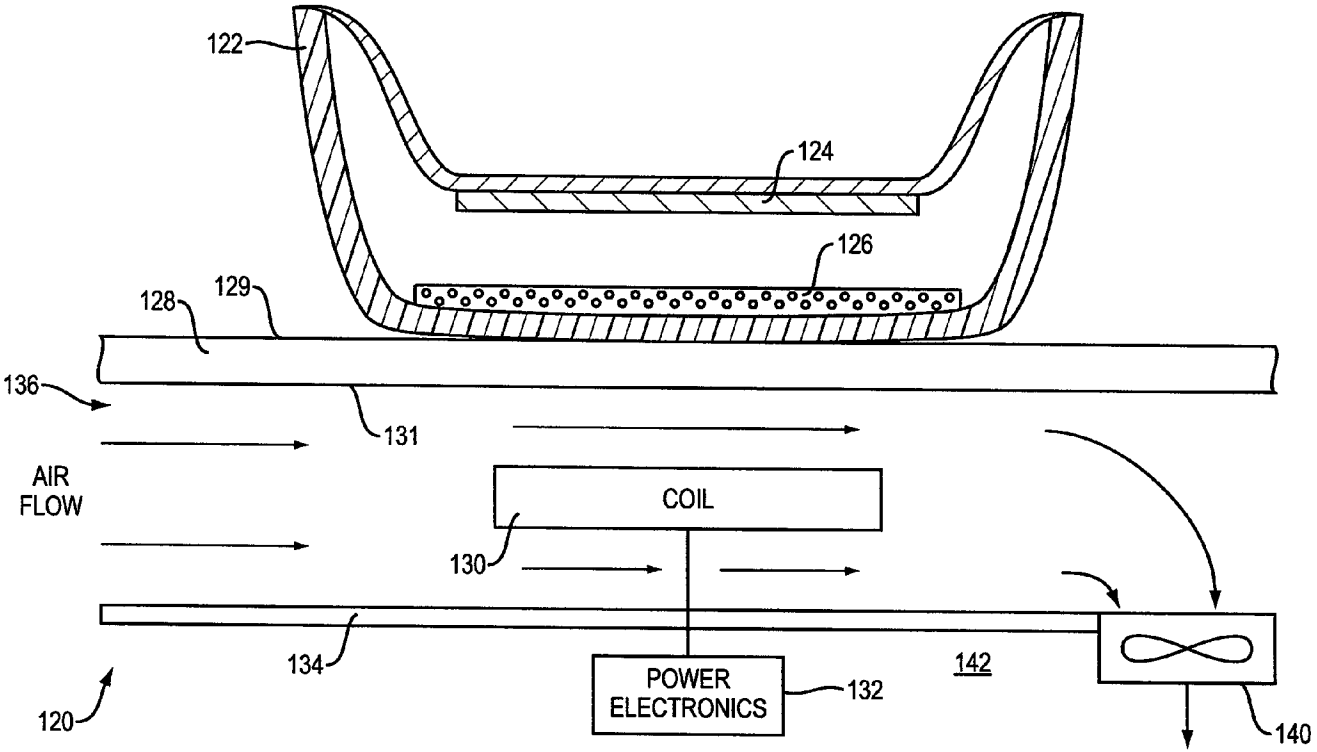
FIG. 3 is a schematic depiction of an arrangement of the cooktop, a piece of cookware and the induction heating system of an induction cooking system.

FIG. 3 schematically depicts induction cooking system 120. Cool touch custom cookware 122 includes target 124 and thermal insulation layer 126. Cookware 122 sits on the top surface 129 of cooktop 128, above electrical coil 130. Electrical power is provided to coil 130 by power electronics module 132.

As described above, the construction and arrangement of cool touch cookware 122, including the use of insulation layer 126 spaced from target 124, results in a cookware outer surface that is relatively cool while the cookware is in use. One result of this arrangement is that the heat flow from cookware 122 into cooktop 128 is relatively modest. Cooktop 128 is preferably maintained at a temperature below that of the outer surface of cookware 122 such that cooktop 128 acts as a heat sink for cookware 122; this assists in maintaining the outer surface of cookware 122 cool enough to be handled by human hands.

When coil 130 is electrically driven, resistive heating of the coil results in the generation of heat. For reasons stated herein, including the efficiency of the electromagnetic coupling between coil 130 and target 124, it is desirable to place coil 130 close to target 124 and thus close to or even potentially embedded within cooktop 128.

As cooktop 128 desirably acts as a heat sink for the cookware, to maintain both the cooktop and cookware at a low temperature it is helpful to assist with heat transfer out of the cooktop. Heat transfer out of the cooktop is enhanced by flowing ambient air over lower surface 131 of cooktop 128. In the present embodiment, air flow is directed through plenum 136 created by placing divider 134 spaced below cooktop 128. Plenum 136 may be coupled to cooktop 128. Coil 130 is located in plenum 136, preferably spaced from both divider 134 and cooktop 128 so that air flows over the top and bottom of the coil. This airflow is induced by fan 140 that pulls air in from the edge of the cooktop, into plenum 136, past the coil, and out of the plenum and into volume 142 located below divider 134. The airflow thus contributes to heat transfer out of the cooktop. The air flow also helps to cool coil 130, which decreases heat transfer from coil 130 to cooktop 128. Power electronics 132 also generate heat; placing them below divider 134 decreases heat transfer from power electronics module 132 to cooktop 128, which also assists in maintaining the cooktop at a relatively low temperature. Cooling air expelled by fan 140 also can help to cool power electronics module 132.

Figure 4A:
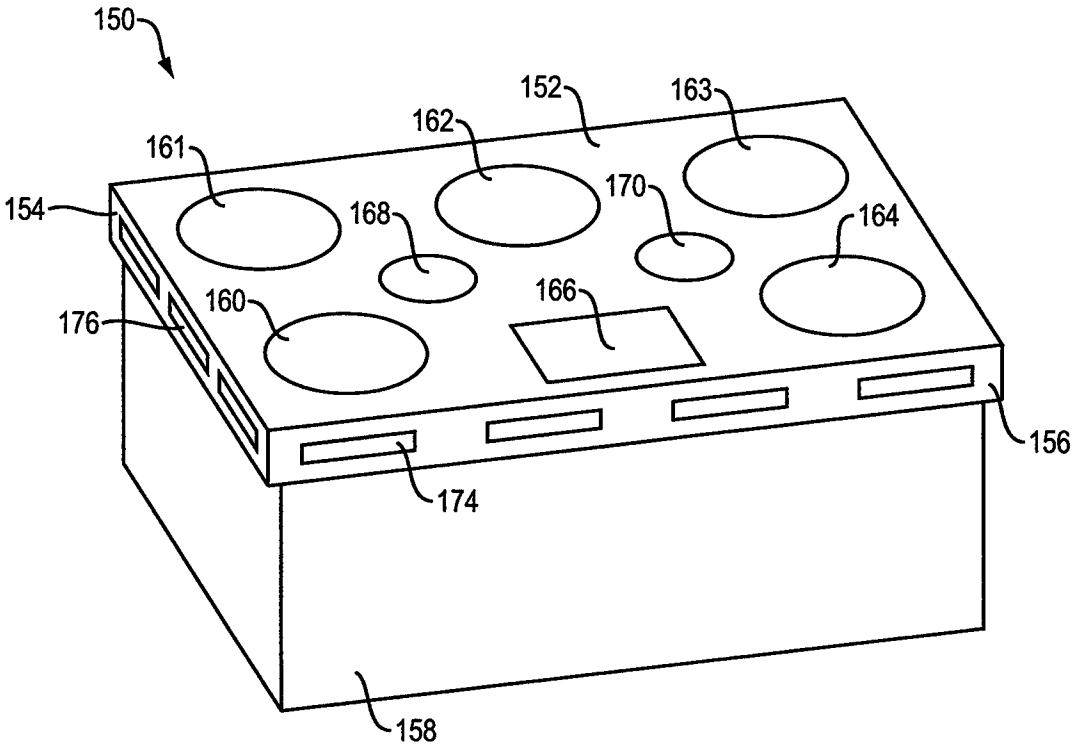
FIGS. 4A and 4B are perspective and top views, respectively, of an induction cooking system.
Figure 4B:
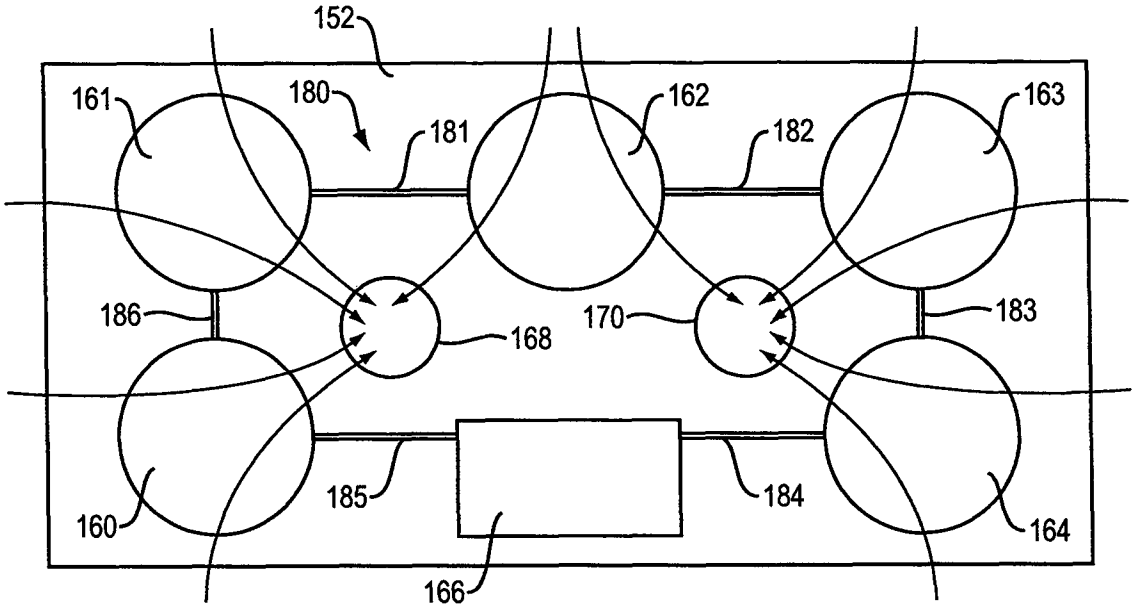

Induction cooking system 150 is shown in FIGS. 4A and 4B. System 150 includes rectangular cooktop 152 that defines four edges, with edges 154 and 156 visible in FIG. 4A. Cooktop 152 is supported by base 158 which can be a kitchen cabinet, a stand, or another support for a cooktop or range, as known in the art. Cooking system 150 includes five induction coils 160-164 located below the cooktop, preferably in the configuration shown in FIG. 3. User control panel 166 is operatively coupled to each of the coils and the related power electronics in a manner known in the art. Fans 168 and 170 are located such that they draw air in through a plenum created by a divider such as divider 134 that has vertical walls (not shown) that are coupled to the cooktop around the edges of the cooktop, to create a rectangular prism-shaped chamber that is close in size to cooktop 152. Openings in the edges of the chamber, such as openings 174 and 176, act as intakes for cooling air drawn in by fans 168 and 170.

In order to direct air over both the bottom of the cooktop and above and below the coils, it is useful to place a baffle 180, FIG. 4B, in the plenum. In this embodiment, baffle 180 comprises baffle sections 181-186 that are vertical walls that span the entire height of plenum 136 to essentially prevent movement of air through the areas in which these walls are located. By locating the walls between adjacent coils, and between the coils that are adjacent to control panel 166 and the control panel, as shown by the arrows in FIG. 4B air flow is generally from the edges of the cooktop, across the lower surface of the cooktop in the area of the coils, and across the coils. Since the cookware is placed down on top of the area of the cooktop just above the coils, the air flow is also directed across the locations of the cooktop (directly above the coils) into which heat is transferred from the cookware into the cooktop. Thus the air flow acts to both cool the cooktop and cool the coils.

Figure 5:
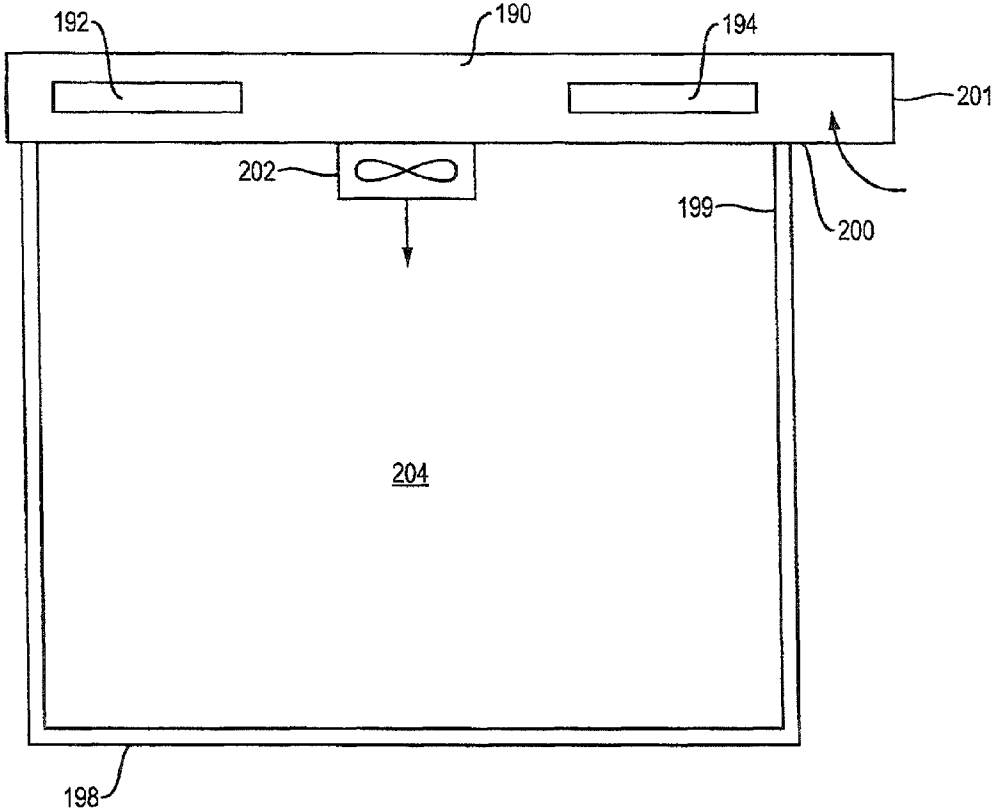
FIG. 5 is a schematic cross-sectional view of an induction cooking system.

FIG. 5 shows a slightly different embodiment of the cooling system arrangement with cooktop 190 placed on base cabinet 198 that defines interior volume 204. In this embodiment, the air inlet to the cooling plenum is at the bottom 200 or perhaps the front face or edge 201 of cooktop 190 in the portion of the cooktop that projects over the top front 199 of cabinet 198. This projecting lip provides an area for air inlet, which can be useful in a case in which one or more of the other edges of the cooktop are not accessible for air inlet. With baffling and proper placement of one or more fans 202, this air can be directed over and above coils 192 and 194 and along the lower surface of the cooktop, in the same manner as explained above. The air is then expelled into volume 204 in which the power electronics modules are located.

A number of embodiments and options have been described herein. Modifications may be made without departing from the spirit and scope of the invention. For example, the custom cool touch cookware may use only a single temperature sensing modality, which would typically be accomplished with a temperature sensor built into the cookware. Also, the cooling system that flows cooling fluid through the cooling chamber located just below the cooktop can be arranged other than as described above. For example the one or more fans may push air through the cooling chamber rather than inducing flow through the chamber. Also, the cooling fluid can be a gas other than air, or can be a liquid. As one example, the cooling system may flow cool water or a refrigerant through the cooling chamber. When a cooling fluid other than air is used, the cooling system may be comprise a closed loop for the coolant, with some means such as a heat exchanger to reject heat from the cooling fluid as necessary.

Accordingly, other embodiments are within the claims.

What is claimed is:

1. An induction cooking appliance comprising:

a cooktop having an upper surface and a lower surface;

one or more electrical coils located just below the lower surface of the cooktop or embedded within the cooktop;

a coil drive system that is located below the cooktop and is operatively connected to the coils such that the coil drive system provides alternating current that directly causes the coils to produce a time-varying electromagnetic field;

a controller that controls the provision of alternating current by the coil drive system to the coils;

a user-operable control that is operationally coupled to the controller;

a divider spaced below the cooktop and below the coils, where a cooling plenum is defined between the lower surface of the cooktop and the divider, and wherein the electrical coils are located within or directly exposed to the cooling plenum;

wherein the coil drive system is located in a volume that is below the cooktop and is separate from the cooling plenum; and one or more fans that flow air through the cooling plenum and thus over the lower surface of the cooktop and over the coils, to cool both the cooktop and the coils.

2. The induction cooking appliance of claim 1 wherein the fans draw air into the cooling plenum.

3. The induction cooking appliance of claim 1 wherein the cooktop is generally planar, relatively thin, and has an edge along its perimeter, and wherein the cooling plenum has air inlet openings in or proximate the edge of the cooktop.

4. The induction cooking appliance of claim 3 wherein the cooktop perimeter is generally rectangular and has four edges, and the air inlet openings are in or proximate all four edges.

5. The induction cooking appliance of claim 3 wherein the cooktop is supported by a base that has a top front edge, and the cooktop has a lip portion that extends past the top front edge of the base such that the lip portion projects forward of the top of the base, and wherein the air inlet openings are in the lip portion of the cooktop.

6. The induction cooking appliance of claim 2 wherein the electrical coils are located in the cooling plenum.

7. The induction cooking appliance of claim 6 wherein the electrical coils are spaced from both the lower surface of the cooktop and the divider.

8. The induction cooking appliance of claim 7 wherein the electrical coils are separated by spaces, and the cooling chamber further comprises baffles that span the spaces between the coils, the baffles extending essentially from the lower surface of the cooktop to the divider, so as to inhibit air flow through the plenum other than over the coils and over the bottom of the cooktop.

9. The induction cooking appliance of claim 6 wherein the cooling plenum defines unoccupied air gaps between the tops of each of the coils and the adjacent lower surface of the cooktop, so that the air flows over both the top and bottom of the coils.

10. The induction cooking appliance of claim 1 wherein the volume in which the coil drive system is located, is below the cooling plenum.

11. The induction cooking appliance of claim 1 further comprising:

custom cookware configured to be placed on the cooktop above at least one of the one or more electrical coils;

a temperature sensor that senses a temperature of the custom cookware.

12. The induction cooking appliance of claim 11 wherein the custom cookware comprises an outer wall configured to be placed on the cooktop and an inner wall comprising a target formed of an electrically conductive material, wherein an electrical current is induced in the target by the time-varying: electromagnetic field generated by the electrical coil, and wherein the temperature sensor senses a temperature of the target.

13. The induction cooking appliance of claim 12 wherein the custom cookware further comprises a layer of thermal insulation material spaced below the target.

14. The induction cooking appliance of claim 13 wherein the temperature of the cooktop underneath a portion of the outer wall of the custom cookware that is on the cooktop is less than the temperature of the portion of the outer wall of the custom cookware that is on the cooktop.

15. An induction cooking appliance comprising:

a generally planar, relatively thin cooktop that has an edge along its perimeter, the cooktop having an upper surface and a lower surface;

power electronics;

a plurality of electrical coils that are separated by and located just below the lower surface of the cooktop;

a coil drive system that is located below the cooktop and is operatively connected to the coils such that the coil drive system provides alternating current that directly causes the coils to produce a time-varying electromagnetic field;

a controller that controls the provision of alternating, current by the coil drive system to the coils;

a user-operable control that is operationally coupled to the controller;

a divider spaced below the cooktop and below the coils, where a cooling plenum is defined between the lower surface of the cooktop and the divider and has air inlet openings in or proximate the edge of the cooktop, and wherein the electrical coils are located in the cooling plenum;

wherein the coil drive system is located in a volume that is located below the cooling plenum and that is separate from the cooling plenum and;

one or more fans that draw air into the cooling plenum and thus over the lower surface of the cooktop and over the coils, to cool both the cooktop and the coils; and wherein the cooling plenum further comprises baffles that span the spaces between the coils, the baffles extending essentially from the lower surface of the cooktop to the divider, so as to inhibit air flow through the plenum other than over the coils and over the bottom of the cooktop.

16. The induction cooking appliance of claim 15 wherein the cooktop is supported by a base that has a top front edge, and the cooktop has a lip portion that extends past the top front edge of the base such that the lip portion projects forward of the top of the base, and wherein the air inlet openings of the cooling plenum are in the lip portion of the cooktop.

17. The induction cooking appliance of claim 10 wherein the one or more fans are located between the cooling plenum and the volume in which the coil drive system is located, such that the one or more fans draw air through the cooling plenum and then force the air into the volume in which the coil drive system is located.

18. The induction cooking appliance of claim 15 wherein the cooktop perimeter is generally rectangular and has four edges, and the air inlet openings of the cooling plenum are in or proximate all four edges.

19. The induction cooking appliance of claim 15 wherein the one or more fans are located between the cooling plenum and the volume in which the coil drive system is located, such that the fans draw air through the cooling plenum and then force the air into the volume in which the coil drive system is located.

* * * * *